US010653217B1

(12) United States Patent
Capic

(10) Patent No.: US 10,653,217 B1
(45) Date of Patent: May 19, 2020

(54) TRACKABLE WALKING CANE ASSEMBLY

(71) Applicant: Cedomir Capic, Darien, IL (US)

(72) Inventor: Cedomir Capic, Darien, IL (US)

( * ) Notice: Subject to any disclaimer, the term of this patent is extended or adjusted under 35 U.S.C. 154(b) by 0 days.

(21) Appl. No.: 16/286,795

(22) Filed: Feb. 27, 2019

(51) Int. Cl.
*A45B 3/00* (2006.01)
*A45B 9/04* (2006.01)
*A45B 9/00* (2006.01)

(52) U.S. Cl.
CPC ..... *A45B 3/00* (2013.01); *A45B 9/04* (2013.01); *A45B 2009/007* (2013.01)

(58) Field of Classification Search
CPC ..... A45B 3/00
See application file for complete search history.

(56) References Cited

U.S. PATENT DOCUMENTS 1,824,449 A 9/1931 Sjoberg
D259,371 S 6/1981 Boehm
5,176,160 A 1/1993 Osborn
6,772,778 B2 * 8/2004 Morosini ..... A45B 3/02 135/65
6,774,795 B2 * 8/2004 Eshelman ..... A61B 5/0002 340/539.1
7,188,634 B2 3/2007 Coakley, Sr.
7,551,076 B2 6/2009 Tyroler
7,654,275 B2 * 2/2010 Ewell ..... A45B 3/00 135/66
8,919,362 B1 12/2014 Mortenson
9,357,348 B2 * 5/2016 Evans ..... H04W 4/21
2005/0211284 A1 * 9/2005 Dooley ..... A45B 3/00 135/65
2008/0072940 A1 * 3/2008 Cheng ..... A45B 3/00 135/66
2009/0038663 A1 * 2/2009 Juslin ..... A45B 3/00 135/66
2017/0006981 A1 * 1/2017 Samson ..... A45B 3/00

* cited by examiner

*Primary Examiner* — Noah Chandler Hawk

(57) ABSTRACT

A trackable walking cane assembly for locating a misplaced walking cane includes a walking cane that is manipulated for assisting a physical disabled user with walking. A tracking unit is positioned within the cane and the tracking unit is in electrical communication with a global positioning system (gps) to determine a physical location of the cane. A remote control is manipulated by a user when the user misplaces the cane. The remote control selectively emits a location signal to the tracking unit thereby actuating the tracking unit to emit an audible alert. In this way the tracking unit to assists the user with locating the cane.

9 Claims, 5 Drawing Sheets

TRACKABLE WALKING CANE ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to walking cane devices and more particularly pertains to a new walking cane device for locating a misplaced walking cane.

BRIEF SUMMARY OF THE INVENTION

An embodiment of the disclosure meets the needs presented above by generally comprising a walking cane that is manipulated for assisting a physical disabled user with walking. A tracking unit is positioned within the cane and the tracking unit is in electrical communication with a global positioning system (gps) to determine a physical location of the cane. A remote control is manipulated by a user when the user misplaces the cane. The remote control selectively emits a location signal to the tracking unit thereby actuating the tracking unit to emit an audible alert. In this way the tracking unit to assists the user with locating the cane.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
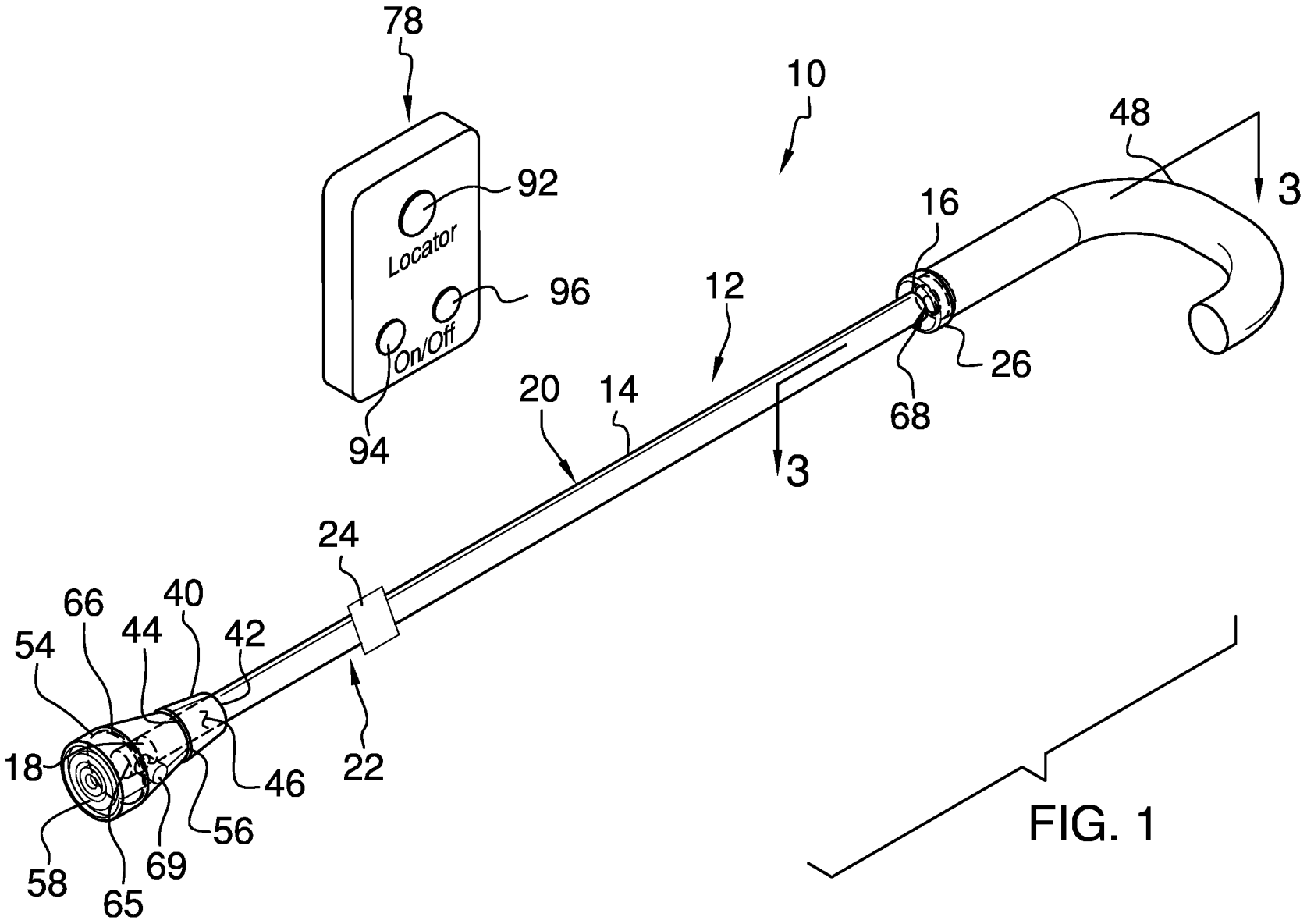
FIG. 1 is a perspective view of a trackable walking cane assembly according to an embodiment of the disclosure.
Figure 2:
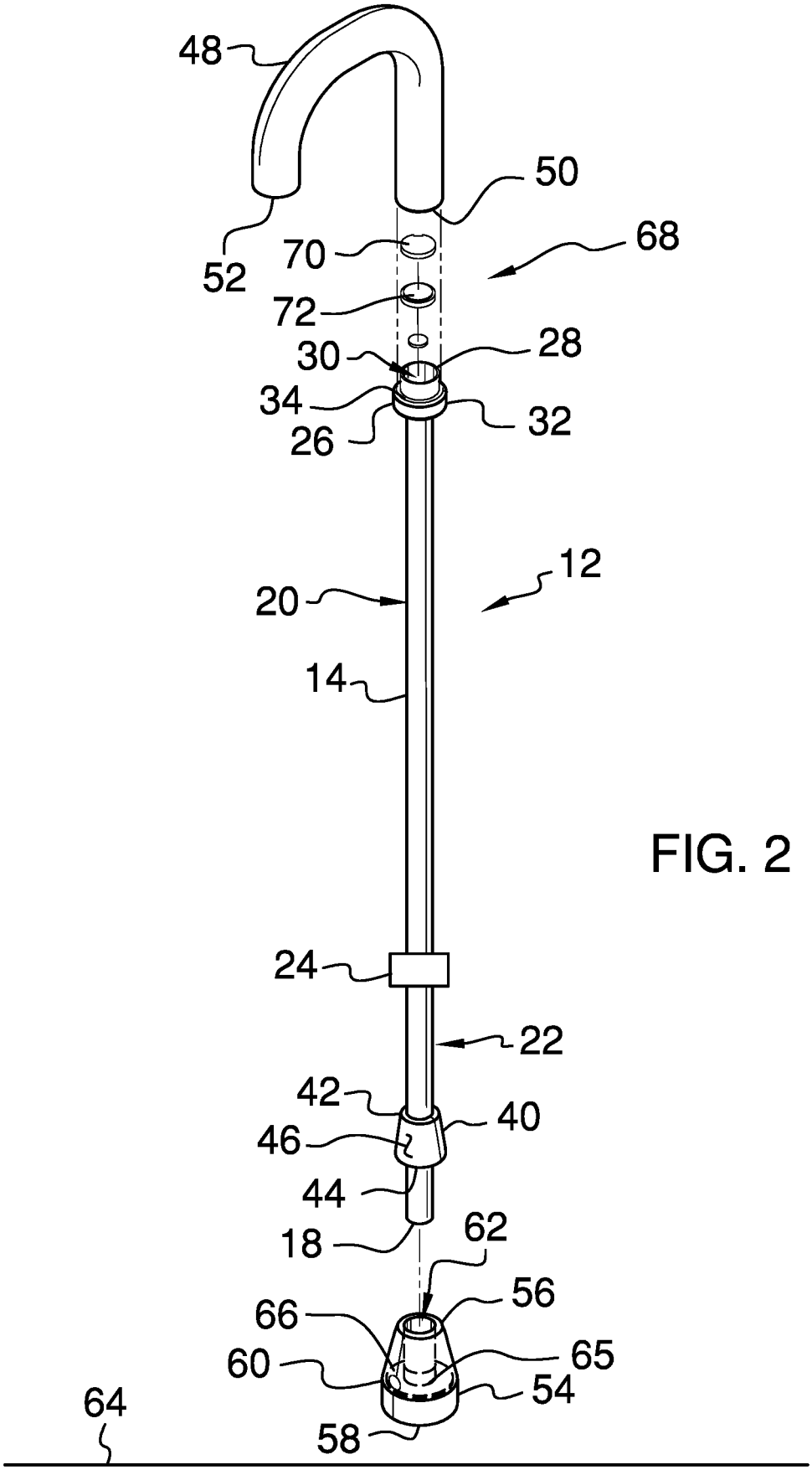
FIG. 2 is an exploded perspective view of an embodiment of the disclosure.
Figure 3:
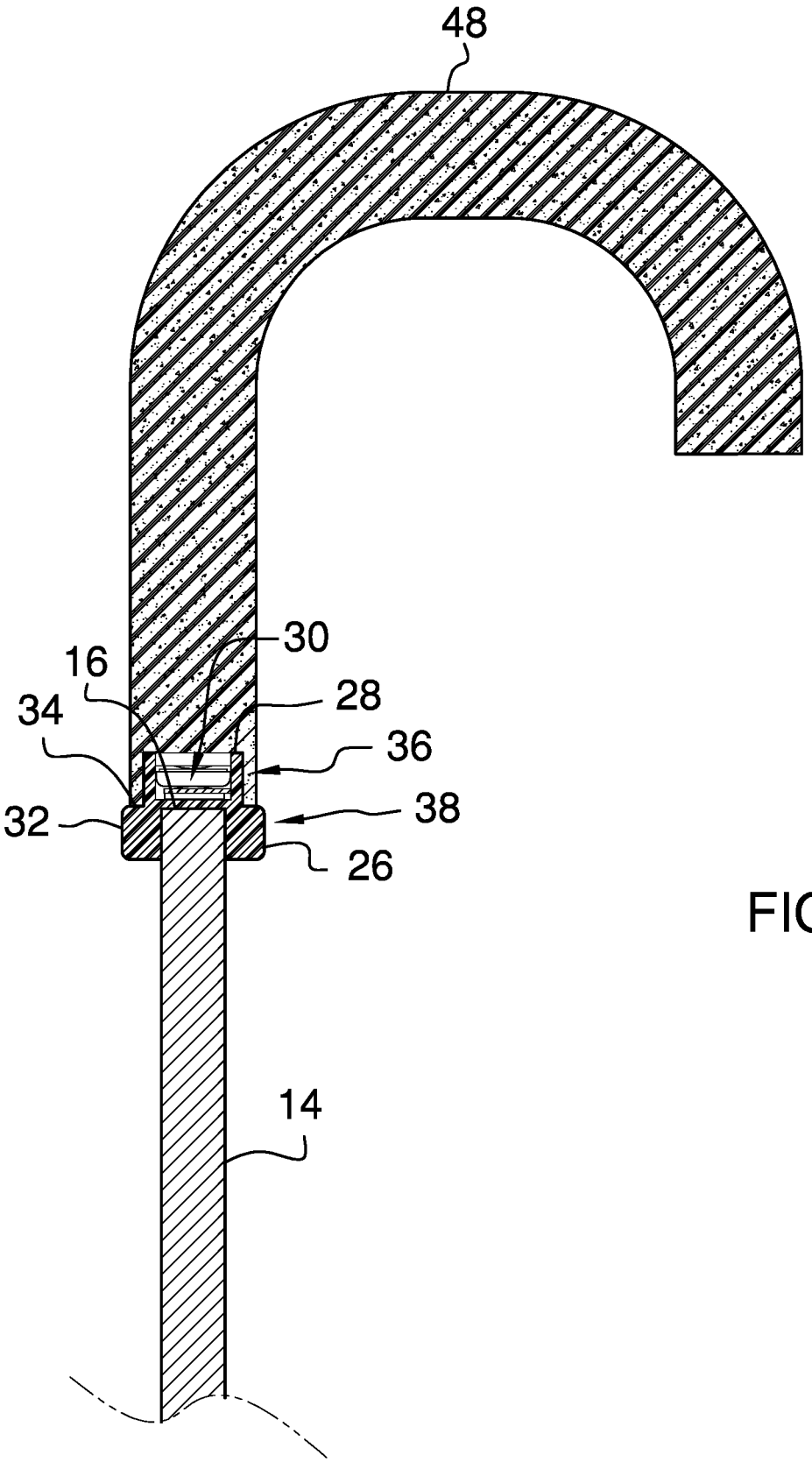
FIG. 3 is a cross sectional taking along line 3-3 of FIG. 1 view of an embodiment of the disclosure.
Figure 4:
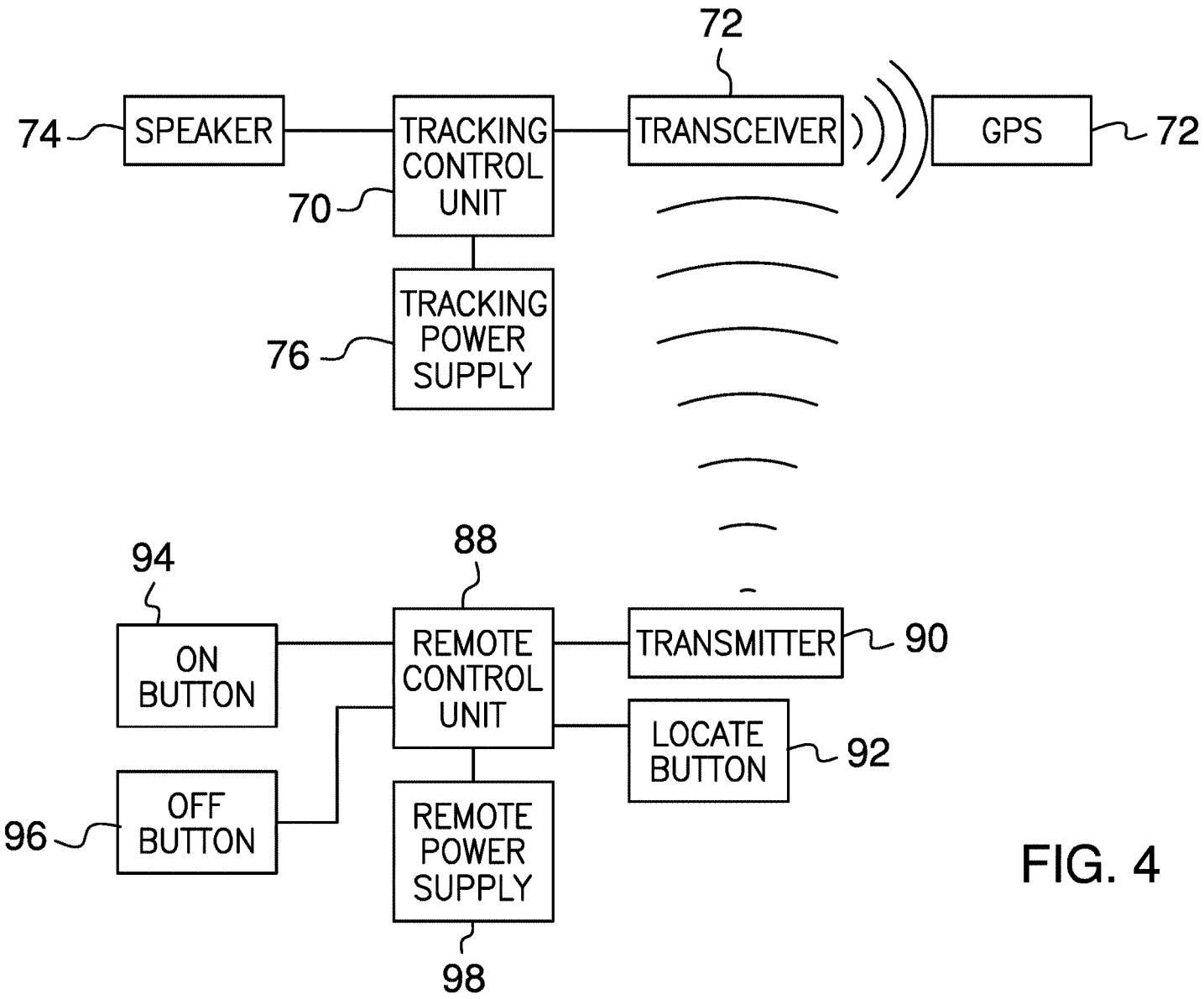
FIG. 4 is a schematic view of an embodiment of the disclosure.
Figure 5:
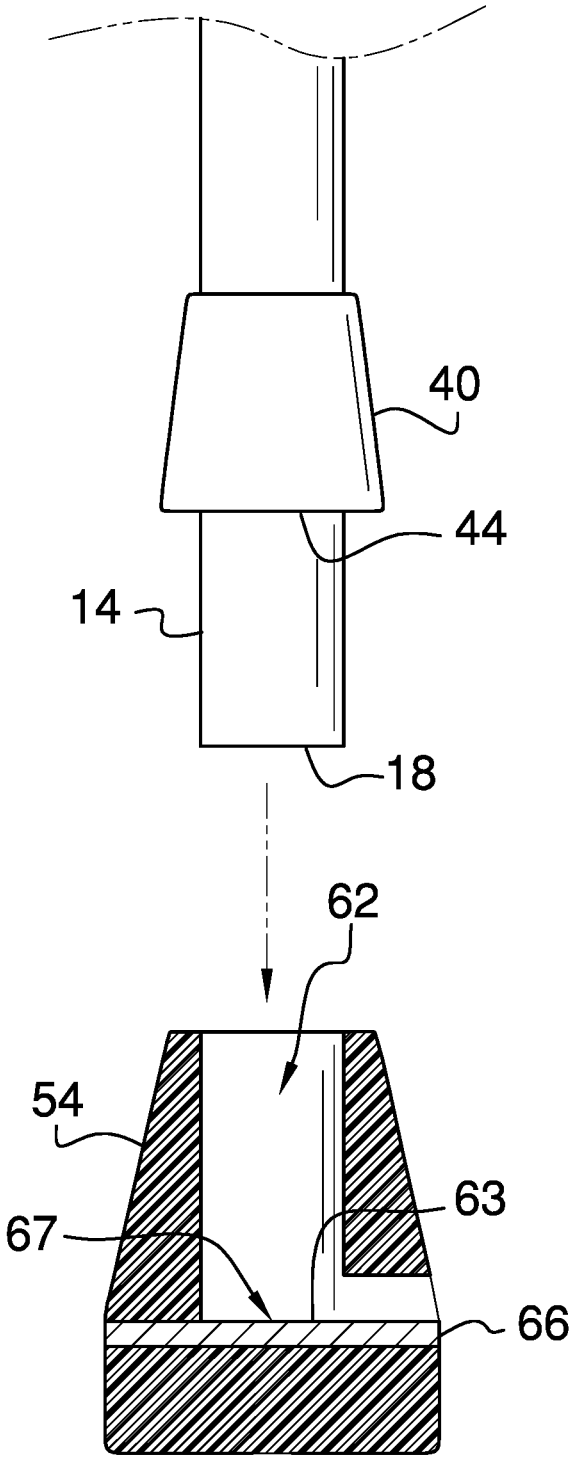
FIG. 5 is a front cut-away view of an embodiment of the disclosure showing a shaft being inserted into a well in a foot.

With reference now to the drawings, and in particular to FIGS. 1 through 5 thereof, a new walking cane device embodying the principles and concepts of an embodiment of the disclosure and generally designated by the reference numeral 10 will be described.

As best illustrated in FIGS. 1 through 5, the trackable walking cane assembly 10 generally comprises a walking cane 12 that is manipulated for assisting a physical disabled user with walking. The walking cane 12 comprises a shaft 14 that has a first end 16 and a second end 18. Additionally, the shaft 14 is comprised of a first section 20 that slidably engages a second section 22 such that the shaft 14 has a telescopically adjustable length. A collar 24 is rotatably coupled around the first section 20 of the shaft 14. The collar 24 frictionally engages the second section 22 of the shaft 14 when the collar 24 is tightened for retaining the shaft 14 at a selected length.

A handle stop 26 is positioned around the first end 16 of the shaft 14 and the handle stop 26 has a distal end 28 with respect to the shaft 14. The distal end 28 has a well 30 extending toward the first end 16 of the shaft 14. Moreover, the handle stop 26 has an outer surface 32 and a horizontal surface 34 lying on a perpendicular plane with respect to the outer surface 32 thereby defining an upper portion 36 of the outer surface and a lower portion 38 of the outer surface. The upper portion 36 has a diameter that is less than a diameter of the lower portion 38.

A foot stop 40 is positioned around the shaft 14 and the foot stop 40 is spaced from the second end 18. The foot stop 40 has an upper end 42, a lower end 44 and an outside surface 46 extending therebetween. The outside surface 46 is continuously arcuate such that the foot stop 40 has a cylindrical shape and the outside surface 46 angles inwardly between the lower 44 and upper 42 ends. The lower end 44 of the foot stop 40 may be spaced a distance of approximately 1.375 inches from the second end 18.

A handle 48 is included that has a primary end 50 and a secondary end 52. The handle 48 is curved between the primary 50 and secondary 52 ends having the primary end 50 being spaced from the secondary end 52 such that the handle 48 forms a U shape. The primary end 50 is open and the primary end 50 insertably receives the upper portion 36 of the handle stop 26 until the primary end 50 abuts the horizontal surface 34 of the handle stop 26. In this way the handle 48 is releasably retained on the shaft 14.

A foot 54 is included that has a top end 56, a bottom end 58 and an outer wall 60 extending therebetween. The outer wall 60 is continuously arcuate such that the foot 54 has a cylindrical shape. Moreover, the outer wall 60 tapers inwardly between the bottom 58 and top 56 ends. The top end 56 has a well 62 extending downwardly toward the bottom end 58 and the well has a lower bounding surface 63. The well 62 may have an inside diameter of approximately 0.875 inches and a depth of approximately 1.75 inches. The outer wall 60 flares outwardly adjacent to the lower bounding surface 63 of the well 62 and the foot 54 may have an overall height of approximately 2.375 inches.

The well 62 in the foot 54 insertably receives the second end 18 of the shaft 14 until the top end 56 of the foot 54 abuts the lower end 44 of the foot stop 40. Thus, the second end of the shaft is spaced a distance of approximately 0.375 inches from the lower bounding surface 63 of the well 62 in the foot 54. In this way an air cushion 65 is created between the lower bounding surface 63 and the second end 18 of the shaft 14 for enhancing comfort for the physically disabled user. The bottom end 58 of the foot 54 abuts a support surface 64, such as a floor or the like, when the walking cane 12 is used for walking. Additionally, the foot 54 is comprised of a resiliently compressible material for frictionally engaging the support surface 64 and thereby enhancing traction on the support surface 64.

A disk 66 is integrated into the foot 54 and the disk 66 lies on a plane that is oriented parallel to the bottom end 58 of the foot 54. The disk 66 is aligned with the lower bounding surface 65 of the well 62 in the foot 54. Moreover, the disk 66 is comprised of a rigid material, such as steel or the like, for reducing deformation of the foot 54 when the cane is used for walking. The outer wall 60 of the foot 54 has an air hole 69 extending into an interior of the foot 54 and the air hole 69 extends through the outer wall 60 above the disk 66. Thus, the well 62 in the foot 54 is in fluid communication with the air hole 69 in the foot 54, thereby facilitating air to exit the air hole 69 when the foot 54 is compressed.

A tracking unit 68 is provided and the tracking unit 68 is positioned within the cane. The tracking unit 68 is in electrical communication with a global positioning system 70 (gps) for determining a physical location of the walking cane 12. The tracking unit 68 comprises a tracking control circuit 70 that is positioned in the well 30 in the handle stop 26. A transceiver 72 is positioned in the well in the handle stop 26 and the transceiver 72 is electrically coupled to the tracking control circuit 70. The transceiver 72 is in wireless electrical communication with the gps 70 and the transceiver 72 may be a radio frequency transceiver or the like. Additionally, the transceiver 72 may be in wireless electrical communication with a smart phone or the like for facilitating the smart phone to display the physical location of the walking cane 12. The tracking control circuit 70 may receive an alert input when the gps signal determines that the cane has moved beyond a trigger distance of the physically disabled user. The trigger distance may be one of a plurality of selectable distances, perhaps ranging between 100.0 feet, 500.0 feet and 1000.0 feet.

A speaker 74 is positioned in the well in the handle stop 26 and the speaker 74 is electrically coupled to the tracking control circuit 70. The speaker 74 emits an audible alert when the tracking control circuit 70 receives the alert input. The speaker 74 may be an electronic speaker 74 or the like. A tracking power supply 76 is positioned in the well in the handle stop 26, the tracking power supply 76 is electrically coupled to the tracking control circuit 70 and the tracking power supply 76 comprises at least one battery.

A remote control 78 is provided and the remote control 78 is manipulated by a user when the user misplaces the cane. The remote control 78 selectively emits a location signal to the tracking unit 68 thereby actuating the tracking unit 68 to emit an audible alert. In this way the tracking unit 68 assists the user with locating the cane. The remote control 78 comprises a housing 80 that has a back wall 82 and a front wall 84. A magnet 86 is coupled to the back wall 82 to magnetically engage a metallic surface, such as an outer wall 60 of a refrigerator or the like, for storing the housing 80 on the metallic surface.

A remote control circuit 88 is positioned within the housing 80. A transmitter 90 is positioned within the housing 80 and the transmitter 90 is electrically coupled to the remote control circuit 88. The transmitter 90 emits an alert signal when the remote control circuit 88 receives a first input. Additionally, the transmitter 90 is in wireless electrical communication with the transceiver 72 and the tracking control circuit 70 receives the alert input when the transceiver 72 receives the alert signal from the transmitter 90. The transmitter 90 may be a radio frequency transmitter or the like.

A locate button 92 is movably coupled to the front wall 84 of the housing 80 and the locate button 92 is electrically coupled to the remote control circuit 88. The remote control circuit 88 receives the first input when the locate button 92 is depressed thereby actuating the transmitter 90 to emit the alert signal. An on button 94 is movably coupled to the front wall 84 of the housing 80, the on button 94 is electrically coupled to the remote control circuit 88 and the on button 94 turns the remote control circuit 88 on when the on button 94 is depressed. An off button 96 is movably coupled to the front wall 84 of the housing 80, the off button 96 is electrically coupled to the remote control circuit 88 and the off button 96 turns the remote control circuit 88 off when the off button 96 is depressed. A remote power supply 98 is positioned in the housing 80, the remote power supply 98 is electrically coupled to the remote control circuit 88 and the remote power supply 98 comprises at least one battery.

In use, the walking cane 12 is employed for assisting the user with walking. The locate button 92 is depressed on the housing 80 of the remote control 78 when the user misplaces the cane. Thus, the speaker 74 emits the audible alert to assist the user with locating the walking cane 12. Additionally, the walking cane 12 can be tracked on the smart phone or other electronic device by displaying the physical location of the walking cane 12 as determined by the gps 70. In this way the walking cane 12 can be located regardless of the location of the walking cane 12 with respect to the user. The speaker 74 additionally emits the audible alert when the walking cane 12 has moved beyond the trigger distance of the physically disabled user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trackable walking cane assembly being configured to selectively emit an audible location alert thereby facilitating a user to locate said assembly, said assembly comprising:

a walking cane being manipulated for assisting a physical disabled user with walking;

a tracking unit being positioned within said cane, said tracking unit being in electrical communication with a global positioning system (gps) wherein said tracking unit is configured to determine a physical location of said cane;

a remote control being manipulated by a user when said user misplaces said cane, said remote control selectively emitting a location signal to said tracking unit thereby actuating said tracking unit to emit an audible alert wherein said tracking unit is configured to assist the user with locating said cane; and wherein said walking cane comprises:

a shaft having a first end and a second end, said shaft being comprised of a first section that slidably engages a second section such that said shaft has a telescopically adjustable length, a handle stop being positioned around said first end of said shaft, said handle stop having a distal end with respect to said shaft, said distal end having a well extending toward said first end of said shaft, said handle stop having an outer surface and a horizontal surface defining an upper portion of said outer surface and a lower portion of said outer surface, said upper portion having a diameter being less than a diameter of said lower portion, a foot stop being positioned around said shaft, said foot stop being spaced from said second end, said foot stop having an upper end, a lower end and an outside surface extending therebetween, said outside surface being continuously arcuate such that said foot stop has a cylindrical shape, said outside surface angling inwardly between said lower and upper ends, and a collar being rotatably coupled around said first section of said shaft, said collar frictionally engaging said second section of said shaft when said collar is tightened for retaining said shaft at a selected length.

2. The assembly according to claim 1, further comprising a handle having a primary end and a secondary end, said handle being curved between said primary and secondary ends having said primary end being spaced from said secondary end such that said handle forms a U shape, said primary end being open, said primary end insertably receiving said upper portion of said handle stop until said primary end abuts said horizontal surface of said handle stop thereby releasably retaining said handle on said shaft.

3. The assembly according to claim 1, further comprising:

a foot having a top end, a bottom end and an outer wall extending therebetween, said outer wall being continuously arcuate such that said foot has a cylindrical shape, said outer wall tapering inwardly between said bottom and top ends;

said top end having a well extending downwardly toward said bottom end, said well in said foot insertably receiving said second end of said shaft until said top end of said foot abuts said lower end of said foot stop wherein said bottom end of said foot is configured to abut a support surface when said cane is used for walking, said foot stop being spaced from said second end of said shaft a distance being less than a depth of said well in said foot such that said second end of said shaft is spaced from a lower bounding surface of said well in said foot.

4. The assembly according to claim 3, further comprising a disk being integrated into said foot, said disk lying on a plane being oriented parallel to said bottom end of said foot, said disk being aligned with said lower bounding surface of said well in said foot, said disk being comprised of a rigid material for reducing deformation of said foot when said cane is used for walking.

5. The assembly according to claim 1, wherein said tracking unit comprises:

a tracking control circuit being positioned in said well in said handle stop; and a transceiver being positioned in said well in said handle stop, said transceiver being electrically coupled to said tracking control circuit, said transceiver being in wireless electrical communication with the gps.

6. The assembly according to claim 5, further comprising a speaker being positioned in said well in said handle stop, said speaker being electrically coupled to said tracking control circuit, said speaker emitting an audible alert when said tracking control circuit receives an alert input; and a tracking power supply being positioned in said well in said handle stop, said tracking power supply being electrically coupled to said tracking control circuit, said tracking power supply comprising at least one battery.

7. The assembly according to claim 5, wherein said remote control comprises:

a housing having a back wall and a front wall;

a magnet being coupled to said back wall wherein said magnet is configured to magnetically engage a metallic surface for storing said housing on the metallic surface;

a remote control circuit being positioned within said housing; and a transmitter being positioned within said housing, said transmitter being electrically coupled to said remote control circuit, said transmitter emitting an alert signal when said remote control circuit receives a first input, said transmitter being in wireless electrical communication with said transceiver, said tracking control circuit receiving said alert input when said transceiver receives said alert signal from said transmitter.

8. The assembly according to claim 5, further comprising:

a locate button being movably coupled to said front wall of said housing, said locate button being electrically coupled to said remote control circuit, said remote control circuit receiving said first input when said locate button is depressed thereby actuating said transmitter to emit said alert signal;

an on button being movably coupled to said front wall of said housing, said on button being electrically coupled to said remote control circuit, said on button turning said control circuit on when said on button is depressed; and an off button being movably coupled to said front wall of said housing, said off button being electrically coupled to said remote control circuit, said off button turning said control circuit off when said off button is depressed; and a remote power supply being positioned in said housing, said remote power supply being electrically coupled to said remote control circuit, said remote power supply comprising at least one battery.

9. A trackable walking cane assembly being configured to selectively emit an audible location alert thereby facilitating a user to locate said assembly, said assembly comprising:

a walking cane being manipulated for assisting a physical disabled user with walking, said walking cane comprising:

a shaft having a first end and a second end, said shaft being comprised of a first section that slidably engages a second section such that said shaft has a telescopically adjustable length;

a handle stop being positioned around said first end of said shaft, said handle stop having a distal end with respect to said shaft, said distal end having a well extending toward said first end of said shaft, said handle stop having an outer surface and a horizontal surface defining an upper portion of said outer surface and a lower portion of said outer surface, said upper portion having a diameter being less than a diameter of said lower portion;

a foot stop being positioned around said shaft, said foot stop being spaced from said second end, said foot stop having an upper end, a lower end and an outside surface extending therebetween, said outside surface being continuously arcuate such that said foot stop has a cylindrical shape, said outside surface angling inwardly between said lower and upper ends;

a collar being rotatably coupled around said first section of said shaft, said collar frictionally engaging said second section of said shaft when said collar is tightened for retaining said shaft at a selected length;

a handle having a primary end and a secondary end, said handle being curved between said primary and secondary ends having said primary end being spaced from said secondary end such that said handle forms a U shape, said primary end being open, said primary end insertably receiving said upper portion of said handle stop until said primary end abuts said horizontal surface of said handle stop thereby releasably retaining said handle on said shaft;

a foot having a top end, a bottom end and an outer wall extending therebetween, said outer wall being continuously arcuate such that said foot has a cylindrical shape, said outer wall tapering inwardly between said bottom and top ends, said top end having a well extending downwardly toward said bottom end, said well in said foot insertably receiving said second end of said shaft until said top end of said foot abuts said lower end of said foot stop wherein said bottom end of said foot is configured to abut a support surface when said cane is used for walking, said foot stop being spaced from said second end of said shaft a distance being less than a depth of said well in said foot such that said second end of said shaft is spaced from a lower bounding surface of said well in said foot; and a disk being integrated into said foot, said disk lying on a plane being oriented parallel to said bottom end of said foot, said disk being aligned with said lower bounding surface of said well in said foot, said disk being comprised of a rigid material for reducing deformation of said foot when said cane is used for walking;

a tracking unit being positioned within said cane, said tracking unit being in electrical communication with a global positioning system (gps) wherein said tracking unit is configured to determine a physical location of said cane, said tracking unit comprising:

a tracking control circuit being positioned in said well in said handle stop;

a transceiver being positioned in said well in said handle stop, said transceiver being electrically coupled to said tracking control circuit, said transceiver being in wireless electrical communication with the gps;

a speaker being positioned in said well in said handle stop, said speaker being electrically coupled to said tracking control circuit, said speaker emitting an audible alert when said tracking control circuit receives an alert input; and a tracking power supply being positioned in said well in said handle stop, said tracking power supply being electrically coupled to said tracking control circuit, said tracking power supply comprising at least one battery; and a remote control being manipulated by a user when said user misplaces said cane, said remote control selectively emitting a location signal to said tracking unit thereby actuating said tracking unit to emit an audible alert wherein said tracking unit is configured to assist the user with locating said cane, said remote control comprising:

a housing having a back wall and a front wall;

a magnet being coupled to said back wall wherein said magnet is configured to magnetically engage a metallic surface for storing said housing on the metallic surface;

a remote control circuit being positioned within said housing;

a transmitter being positioned within said housing, said transmitter being electrically coupled to said remote control circuit, said transmitter emitting an alert signal when said remote control circuit receives a first input, said transmitter being in wireless electrical communication with said transceiver, said tracking control circuit receiving said alert input when said transceiver receives said alert signal from said transmitter;

a locate button being movably coupled to said front wall of said housing, said locate button being electrically coupled to said remote control circuit, said remote control circuit receiving said first input when said locate button is depressed thereby actuating said transmitter to emit said alert signal;

an on button being movably coupled to said front wall of said housing, said on button being electrically coupled to said remote control circuit, said on button turning said control circuit on when said on button is depressed;

an off button being movably coupled to said front wall of said housing, said off button being electrically coupled to said remote control circuit, said off button turning said control circuit off when said off button is depressed; and a remote power supply being positioned in said housing, said remote power supply being electrically coupled to said remote control circuit, said remote power supply comprising at least one battery.

* * * * *